US011690430B2

(12) United States Patent
Heiner et al.

(10) Patent No.: US 11,690,430 B2
(45) Date of Patent: Jul. 4, 2023

(54) WRITING INSTRUMENT CONTAINER ASSEMBLIES

(71) Applicant: SANFORD. L.P., Atlanta, GA (US)

(72) Inventors: Christopher Heiner, Charlotte, NC (US); Timothy Ruth, Charlotte, NC (US)

(73) Assignee: SANFORD, L.P., Atlanta, GA (US)

( * ) Notice: Subject to any disclaimer, the term of this patent is extended or adjusted under 35 U.S.C. 154(b) by 0 days.

(21) Appl. No.: 17/894,602

(22) Filed: Aug. 24, 2022

(65) Prior Publication Data

US 2023/0068673 A1 Mar. 2, 2023

Related U.S. Application Data

(60) Provisional application No. 63/237,200, filed on Aug. 26, 2021.

(51) Int. Cl.

| | |
|---|---|
| ***A45C 11/34*** | (2006.01) |
| ***B43M 99/00*** | (2010.01) |
| ***B43K 21/12*** | (2006.01) |

(52) U.S. Cl.

CPC ..... *A45C 11/34* (2013.01); *B43K 21/12* (2013.01); *B43M 99/008* (2013.01)

(58) Field of Classification Search

CPC ..... A45C 11/34; B43K 21/12; B43M 99/008
USPC ..... 206/214, 224, 371
See application file for complete search history.

(56) References Cited

U.S. PATENT DOCUMENTS

| | | | | |
|---|---|---|---|---|
| 2,617,578 | A * | 11/1952 | Fischer | B65D 85/1009 206/256 |
| 4,534,471 | A * | 8/1985 | Zahn | B43M 99/008 211/163 |
| 4,991,712 | A * | 2/1991 | Wagner | B43M 99/008 206/214 |
| 5,009,336 | A * | 4/1991 | Liaw | B43M 99/008 206/214 |
| 5,377,850 | A * | 1/1995 | Liaw | B43M 99/008 211/11 |
| 6,216,856 | B1 * | 4/2001 | Park | B43M 99/003 206/214 |
| 10,315,832 | B2 | 6/2019 | Ellsworth et al. | |
| 2005/0092648 | A1 * | 5/2005 | Jin | A45C 11/34 206/1.7 |

(Continued)

FOREIGN PATENT DOCUMENTS

IN 321359 B 10/2016

*Primary Examiner* — Jacob K Ackun
(74) *Attorney, Agent, or Firm* — Eversheds Sutherland (US) LLP

(57) ABSTRACT

Embodiments include container assemblies for presentation of contents. In one example, a container assembly for writing instruments may include a slideable platform with a threaded hole configured to operably receive a threaded post therethrough, a housing having at least one guide rail, a manually rotatable base configured to rotate, such that rotation of the manually rotatable base moves the slideable platform within the housing along the at least one guide rail, and at least one platform stopper configured to prevent the slideable platform from advancing past the pre-determined height, wherein the pre-determined height is selected such that the writing instruments are retained by the housing in the container assembly when the slideable platform is in contact with the at least one platform stopper.

20 Claims, 12 Drawing Sheets

(56) References Cited

U.S. PATENT DOCUMENTS

| | | | | |
|---|---|---|---|---|
| 2009/0013566 | A1* | 1/2009 | Cetera | B43M 99/006 206/214 |
| 2009/0218240 | A1* | 9/2009 | Allen | B65D 43/161 206/214 |
| 2012/0093565 | A1 | 4/2012 | Drew | |
| 2013/0193167 | A1 | 8/2013 | Arora et al. | |
| 2016/0366999 | A1* | 12/2016 | Glick | B43M 99/008 |

* cited by examiner

WRITING INSTRUMENT CONTAINER ASSEMBLIES

CROSS-REFERENCE TO RELATED APPLICATION

This application claims the benefit of U.S. Application No. 63/237,200, filed Aug. 26, 2021, which is hereby incorporated by reference in its entirety

TECHNICAL FIELD

The present disclosure is generally related to containers for non-flowable contents, and more particularly to a container assemblies for securing and displaying writing instruments for use.

BACKGROUND

Typically, consumer products such as writing instruments are packaged for retail sale in disposable packaging materials, such as disposable paperboard and plastic packaging materials. However, reusable and/or recyclable packaging is desirable to reduce packaging waste associated with such products.

BRIEF DESCRIPTION OF THE DRAWINGS

Reference is made now to the drawings, which are meant to be exemplary and not limiting, and wherein like elements are numbered alike. The detailed description is set forth with reference to the drawings illustrating examples of the disclosure. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1:
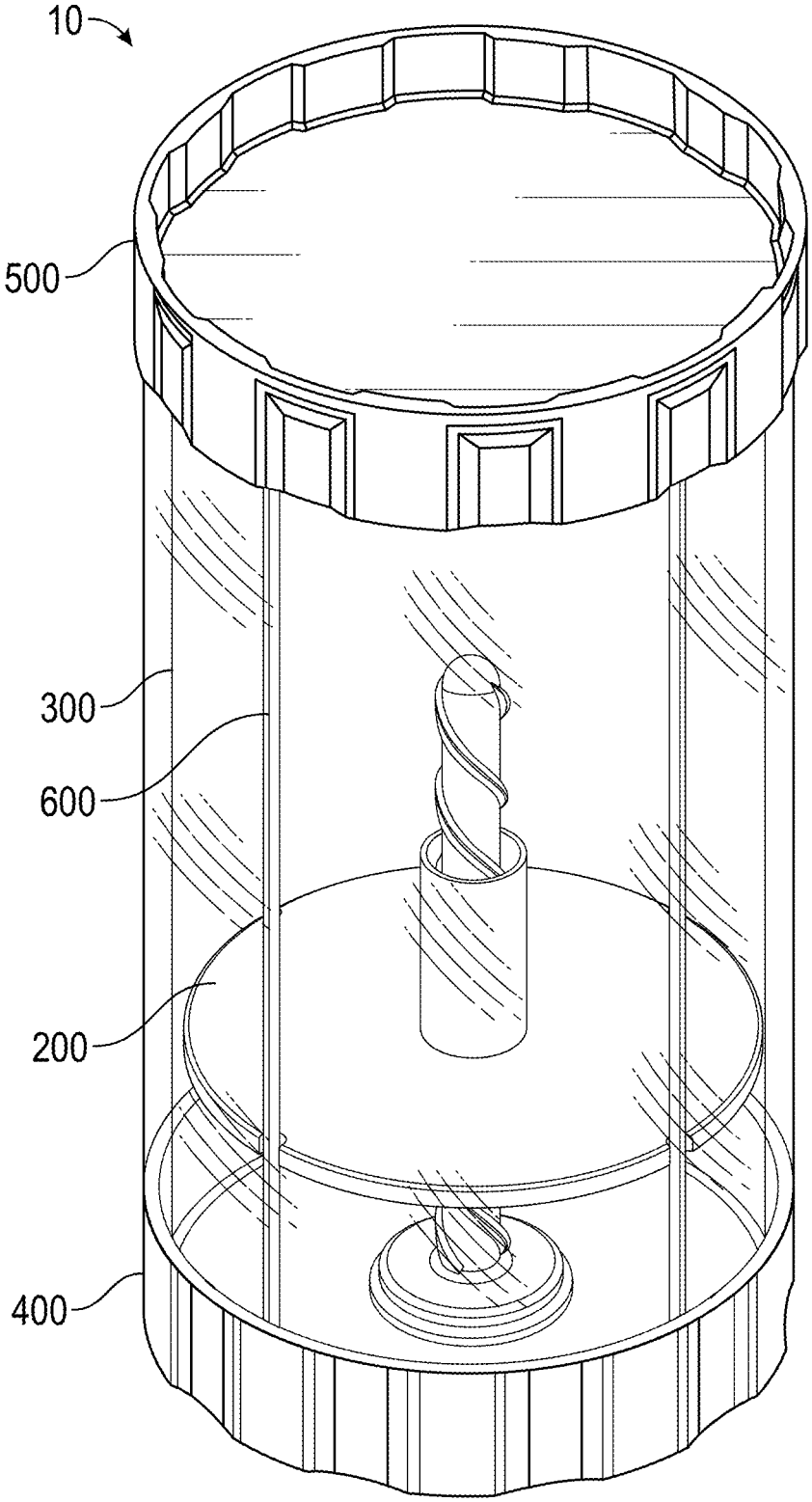
FIG. 1 is a perspective view one embodiment of a writing instrument container assembly, as described herein.

Certain embodiments of the present disclosure are now described with reference to the drawings. Although the following detailed description contains many specifics for purposes of illustration, a person of ordinary skill in the art will appreciate that many variations and alterations to the following details are within the scope of the disclosure. Accordingly, the following embodiments of the disclosure are set forth without any loss of generality to, and without imposing limitations upon, the appended claims.

Reusable container assemblies for securably containing and displaying contents, such as for retail shelf packaging, are provided herein. The container assemblies may be used as the sole or primary packaging for retail display and sale of the contents. For example, the container assemblies may be sealed, such as with an adhesive tape or label, with a relatively small amount of plastic seal material (e.g., around the lid of the container assembly), or with another suitable tamper-evident sealing means. Thus, the container assemblies described herein may reduce the disposable packaging waste associated with traditional retail packages for such goods. In particular, the container assemblies described herein may be useful for dispensing solid products, as opposed to fluid or flowable products such as semi-solid, gel, or similar materials (e.g., glue stick compositions, deodorant or antiperspirant compositions, lip balm compositions). That is, the container assemblies described herein may be particularly useful for packaging non-flowable contents. In certain embodiments, the container assemblies may be suitable for securably containing and displaying writing instruments, such as pens, markers, pencils, and the like, although the container assemblies may be used to package other contents. Thus, while this disclosure generally refers to the container assemblies for use with writing instruments, it should be understood that the disclosure is intended to encompass container assemblies suitable for containing a variety of products, and is not limited to container assemblies for writing instruments.

In certain embodiments, a container assembly for non-flowable contents is provided, including a slideable platform having at least one platform sidewall extending between a top platform surface and a bottom platform surface and having at least one groove, and a threaded hole extending between the top platform surface and the bottom platform surface, the threaded hole being configured to operably receive a threaded post therethrough; a housing having at least one housing sidewall extending between a housing top end and a housing bottom end and surrounding the slideable platform, the at least one housing sidewall comprising an outer housing sidewall surface and an inner housing sidewall surface, the inner housing sidewall surface having at least one guide rail disposed thereon, wherein each of the at least one guide rails is positioned within one of the at least one grooves such that the slideable platform is slideable along each of the at least one guide rails; a manually rotatable base having an upper base surface and a lower base surface, the upper base surface having the threaded post extending therefrom, such that rotation of the manually rotatable base moves the slideable platform within the housing along the at least one guide rail; and at least one platform stopper extending from the inner housing sidewall surface or from at least one of the at least one guide rails at a pre-determined height, the at least one platform stopper being configured to contact the top platform surface to prevent the slideable platform from advancing past the pre-determined height.

In some embodiments, the pre-determined height is selected such that the writing instruments or other contents that the container assembly is configured to contain are retained by the housing in the container assembly when the slideable platform is in contact with the at least one platform stopper. That is, when the slideable platform is advanced to the pre-determined height, the container assembly retains its contents therein, without the contents spilling or tipping out of the housing. For example, for a container assembly configured to contain writing instruments in an upright configuration, when the slideable platform is in contact with the stopper(s) at the pre-determined height, the writing instruments will extend out of and above the container assembly, but will be retained therein. Thus, the container assembly may be used to contain and display contents, such as writing instruments, for frequent use and replacement in the container, such as a desktop writing instrument container or cup.

The container assemblies described herein and the individual components thereof may be made of any suitable materials, such as suitable polymeric materials, like polyethylene terephthalate (PET).

Figure 13:
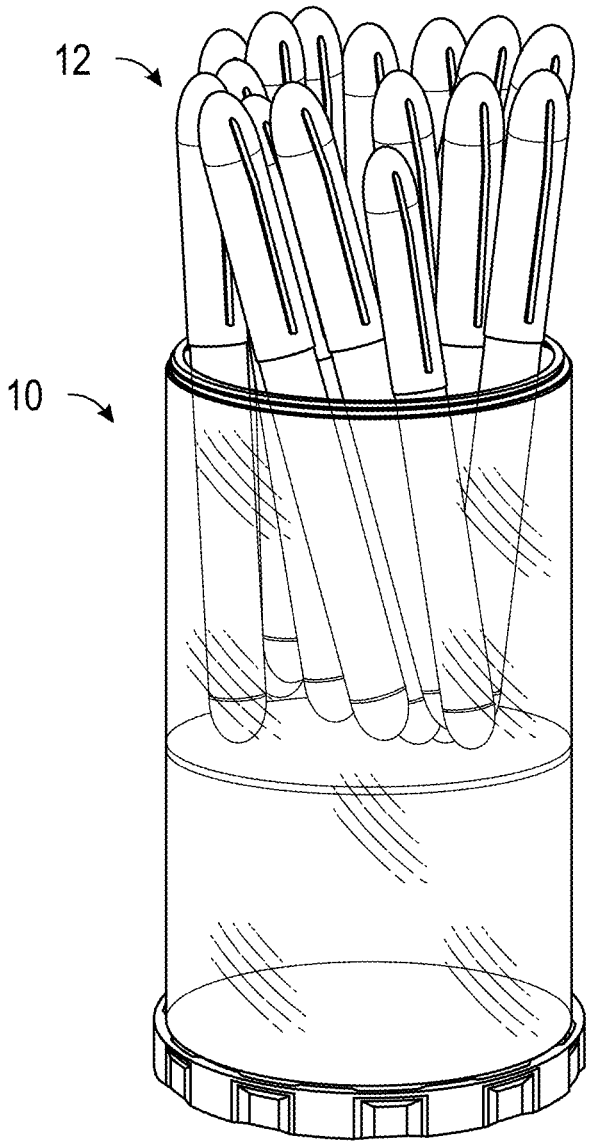
FIG. 13 is a photograph showing one embodiment of a writing instrument container assembly containing writing instruments, with the slideable platform positioned at a pre-determined stopper height.

As shown in FIG. 1, a container assembly 10 includes a slideable platform 200 contained within a housing 300 and configured to be advanced via rotation of a rotatable base 400. The container assembly 10 may include a removable lid 500 for closing off the internal volume of the container. In certain embodiments, the container assembly 10 includes one or more platform stoppers 600, as discussed above, which are configured to prevent movement of the slideable platform past the stopper 600 in the direction of the lid or housing opening. As described, beneficially, the platform stopper 600 may allow for effective storage and display of the contents of the container, including with the contents (e.g., writing instruments 12) extending through the opening of the housing for display and easy grabbing and replacement in the container, without tipping out of the container, as shown in FIG. 13.

Figure 2:
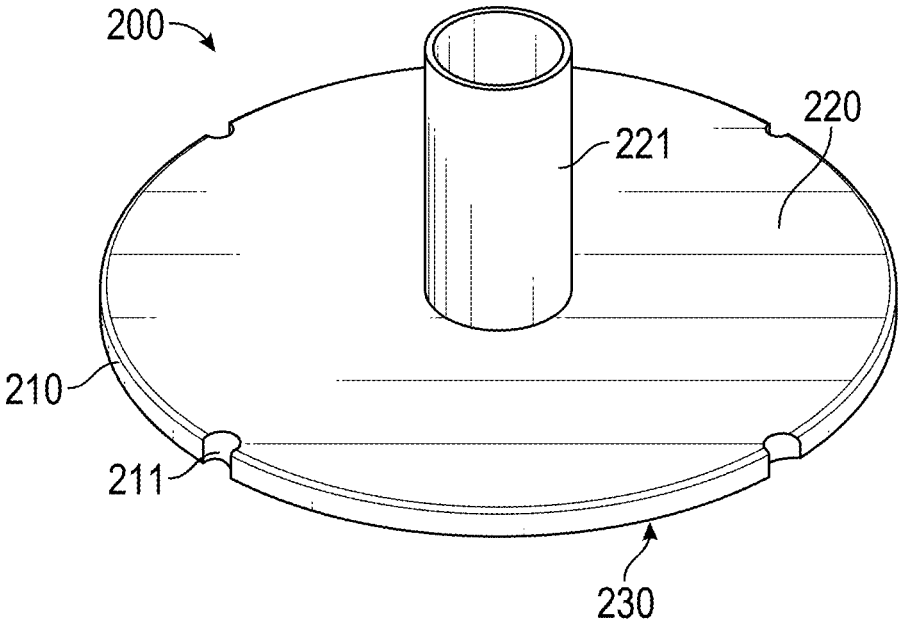
FIG. 2 is a perspective view of one embodiment of a slideable platform for a writing instrument container assembly, as described herein.
Figure 9:
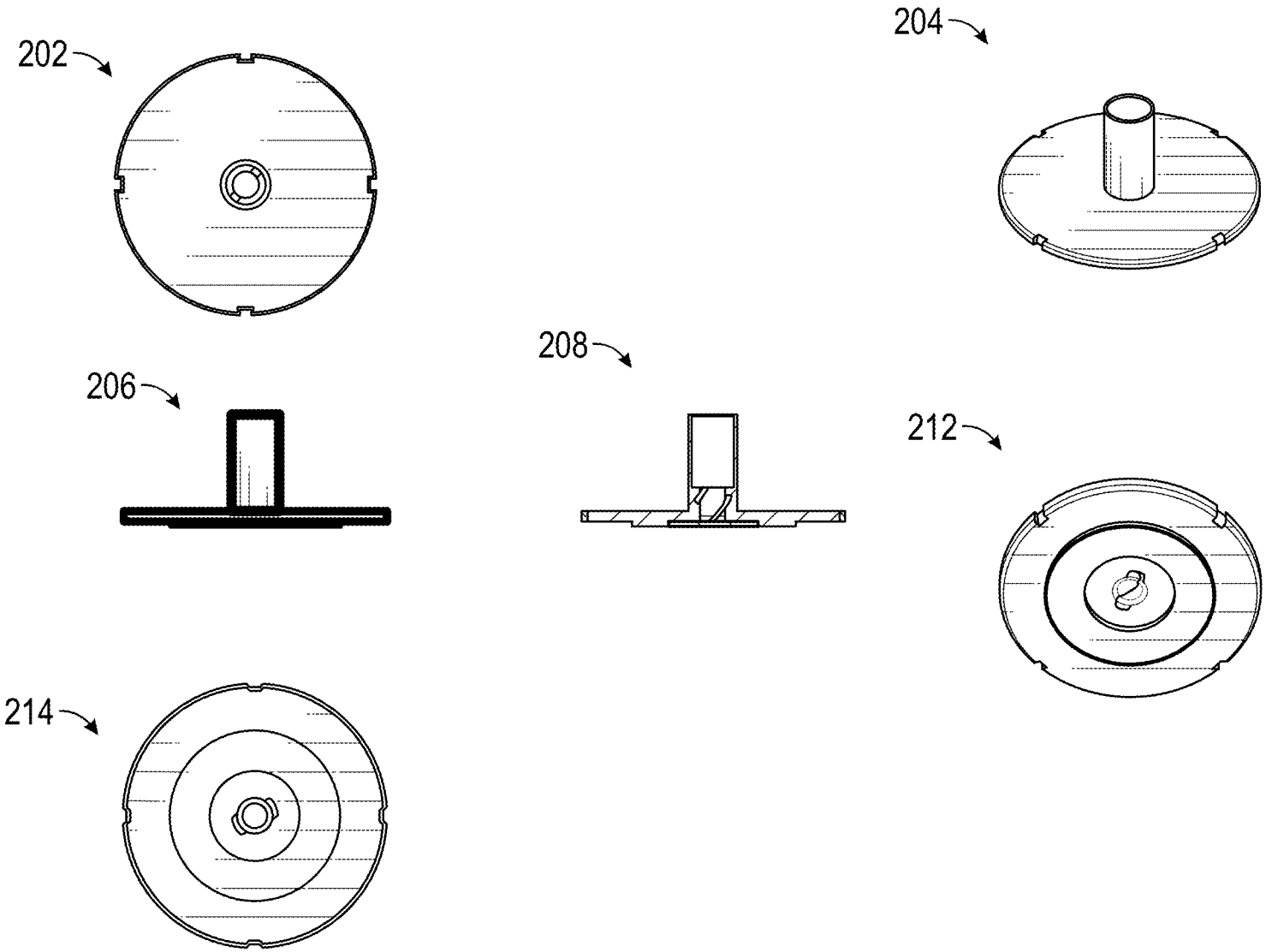
FIG. 9 illustrates various views of one embodiment of a slideable platform for a writing instrument container assembly, as described herein.

As shown in detail in FIGS. 2 and 9, the container assembly 10 includes a slideable platform 200. The slideable platform 200, also referred to as an elevator, may be any suitable platform on which the contents to be contained may be placed for storage, display, and dispensing from the container. In particular, the slideable platform may include a top platform surface 220 and an opposed bottom platform surface 230. The top platform surface 220 may be suitable to receive the contents thereon, as a platform therefor. Moreover, the slideable platform 200 is configured to controllably slide in a direction parallel to a longitudinal axis of the container assembly or housing, to advance or retract the platform within the housing. In this way, the contents in contact with the platform within the housing may be selectively moved between a storage position, in which the contents are wholly contained within the interior volume of the container assembly or housing, and an advanced use position, in which the contents are accessible to a user via the open end of the housing and optionally extend through the open end of the housing, for easy access by a user.

In certain embodiments, the slideable platform 200 includes a platform sidewall 210 extending between the top platform surface 220 and the bottom platform surface 230. The platform sidewall 210 may have one or more grooves 211 formed therein. In certain embodiments, the platform sidewall contains from three to eight grooves, such as from three to five grooves, such as four grooves, although other numbers of grooves may also be used.

The slideable platform 200 also includes a threaded hole extending between the top platform surface 220 and the bottom platform surface 230. For example, the threaded hole may be centrally located on the slideable platform 200. The threaded hold may be configured to operatively receive a threaded post therethrough, to facilitate the advancement and retraction of the platform within the housing. In FIG. 9, the slideable platform 200 is depicted in bottom view 202, perspective view 204, front view 206, cross-sectional view 208, bottom perspective view 212, and top view 214.

In certain embodiments, as shown in the figures, the slideable platform has a flattened cylindrical or disc-like shape. In other embodiments, the slideable platform may have another shape, such as an elliptical, oval, triangular, rectangular/square, hexagonal, or octagonal shape. In certain embodiments, the shape of the slideable platform corresponds to the shape of the inner housing sidewall, and may be dimensioned to contact or nearly contact the surface of the inner housing sidewall, to eliminate any material gap between the slideable platform and the housing.

Figure 7A:
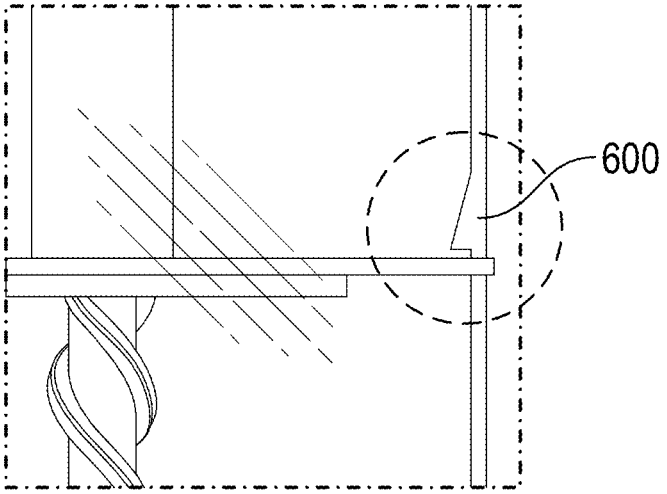
FIG. 7A is a magnified front view of one embodiment of a platform stopper and its interaction with the slideable platform for a writing instrument container assembly, as described herein.
Figure 7B:
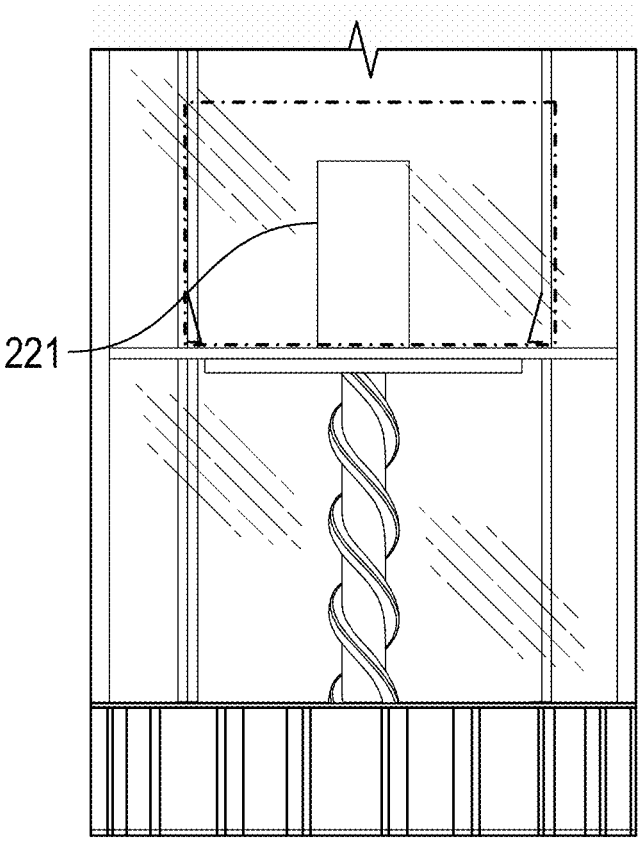
FIG. 7B is a magnified front view of one embodiment of a protective sleeve for a threaded post for a writing instrument container assembly, as described herein.
Figure 8:
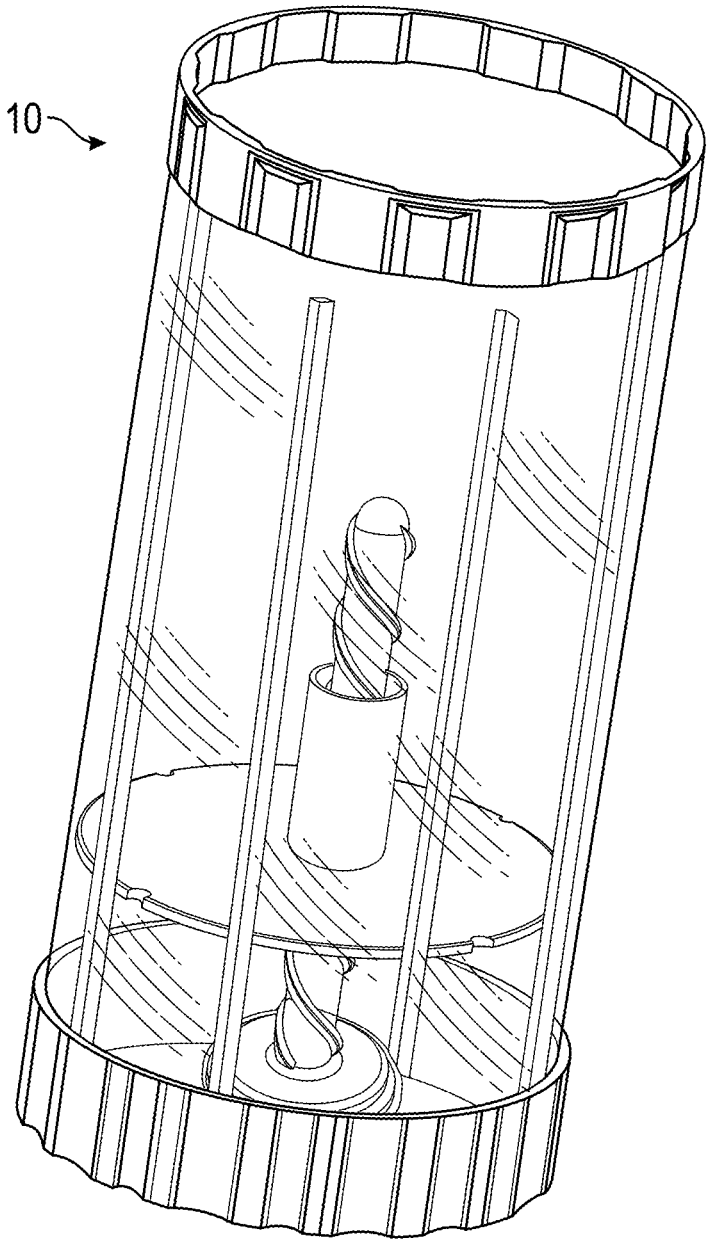
FIG. 8 is another perspective view of the writing instrument container assembly shown in FIG. 1, as described herein.

In some embodiments, as shown in detail in FIG. 7B, the slideable platform includes a protective sleeve 221 extending from the platform, such as from the top platform surface 220. The protective sleeve may also be configured to receive the threaded post therethrough, and may serve to guide the platform along the threaded post and/or to protect the threaded post from contact with or damage caused by the contents of the container that are positioned on the top platform surface 220. In other embodiments, the protective sleeve may extend downward from the bottom platform surface 230.

Figure 3:
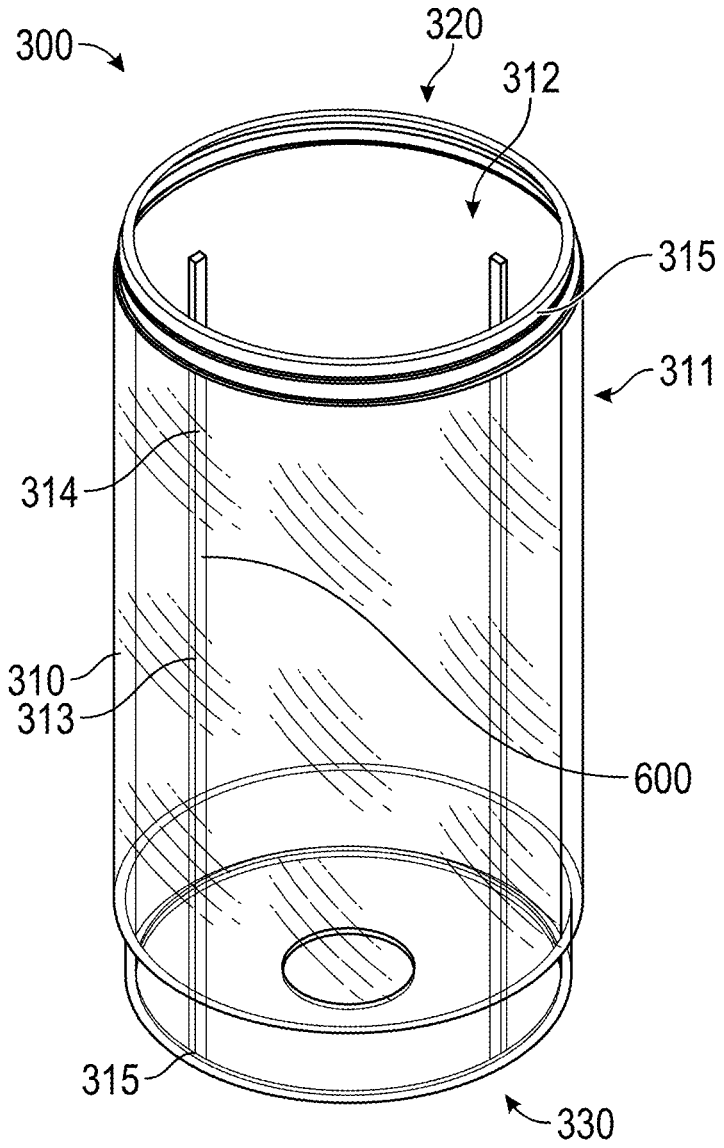
FIG. 3 is a perspective view of one embodiment of a housing for a writing instrument container assembly, as described herein.
Figure 11:
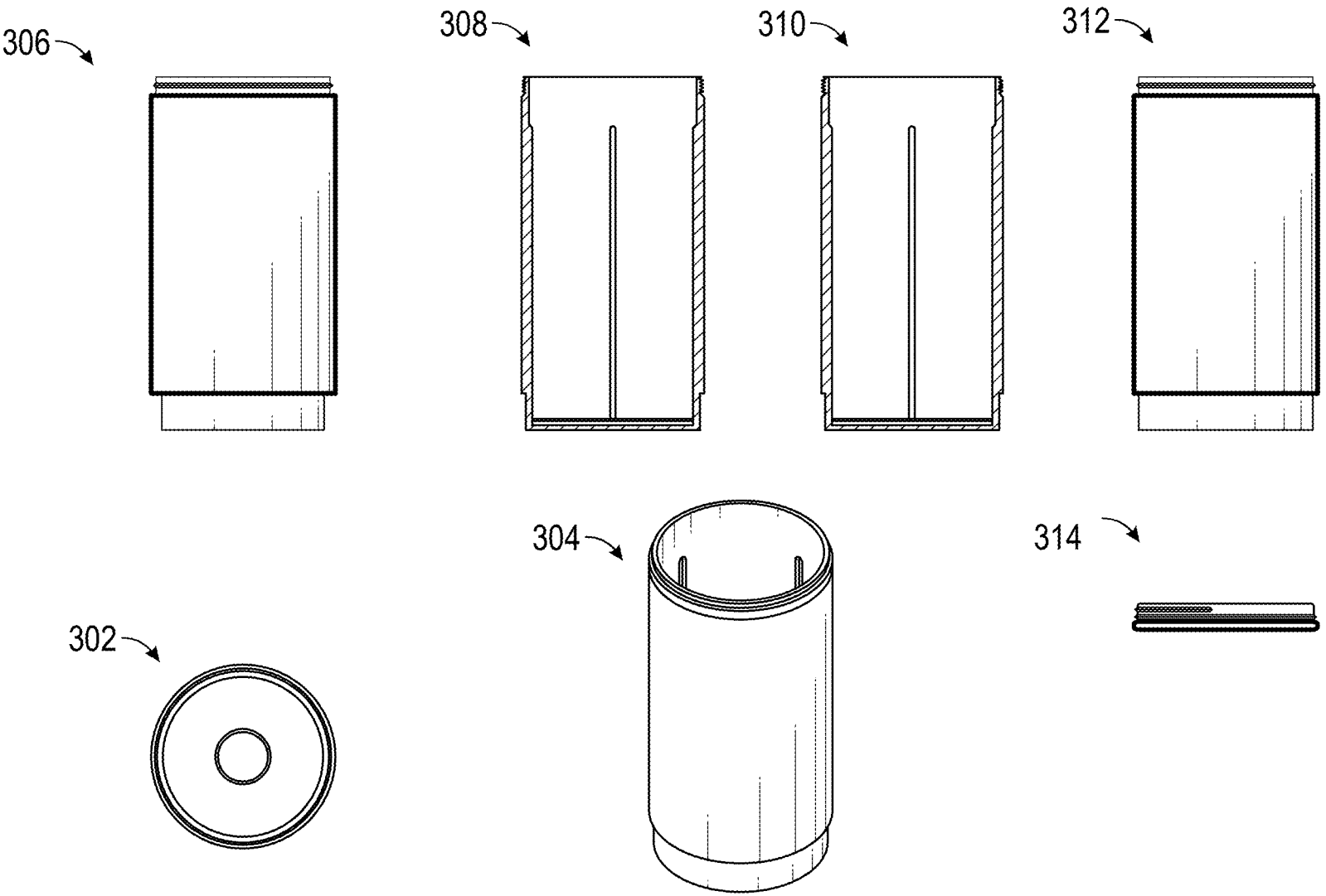
FIG. 11 illustrates various views of one embodiment of a housing for a writing instrument container assembly, as described herein.

As shown in detail in FIGS. 3 and 11, the container assembly 10 also contains a housing 300. The housing may be any suitable geometry and configuration, to define, in combination with the base and lid, the interior volume of the container assembly and surround the slideable platform 200 therein. In certain embodiments, the housing is formed by at least one housing sidewall 310 extending between a housing top end 320 and a housing bottom end 330. The housing may be formed by any variety of suitable sidewalls, such as two, three, four, or more sidewalls. The housing may have any suitable cross-sectional shape formed by the sidewall(s), such as a circular, elliptical, oval, triangular, rectangular/square, hexagonal, or octagonal shape. In the figures, the housing is shown as being formed by a single sidewall having a circular cross-section, such that the housing forms a cylinder. In certain embodiments, the housing is an elongated tube having any suitable cross-sectional shape, with opposed open ends, one for receiving the lid and one for receiving the base, as described herein. In FIG. 11, the housing 300 is depicted in bottom view 302, perspective view 304, front view 306, cross-sectional views 308, 310, rear view 312, and FIG. 11 includes a lid 314.

The housing sidewall 310 has an outer housing sidewall surface 311 and an opposed inner housing sidewall surface 312. The inner housing sidewall surface defines the interior volume of the container assembly. The inner housing sidewall surface 311 has at least one guide rail 313 disposed thereon and extending therefrom. The guide rail(s) may extend along the inner housing sidewall surface 312 in a direction parallel to the longitudinal axis of the container assembly or housing. The guide rails 313 may be sized and shaped to be operably positioned within corresponding grooves 211 of the slideable platform 200, such that the platform is slideable therealong. Thus, the number of guide rails is equal to or less than the number of grooves in the platform, such that each guide rail is positioned within a groove.

In certain embodiments, the housing includes from three to eight guide rails, such as from three to five guide rails, such as four guide rails, although other numbers of guide rails may also be used. It has been discovered that container assemblies having at least three guide rails and at least three corresponding grooves in the platform outperform containers having one or two guide rails and grooves. In particular, it has been found that containers having one or two guide rails and grooves experience more jamming and platform tilting during operation and advancement/retraction of the platform. It has been found that containers having three to eight guide rails and grooves, such as four guide rails and grooves, as shown in the figures, display improved stability and a reduction of jamming. However, it was also discovered that increasing the number of guide rails and grooves above four or five may result in increased friction and resistance to advancing the slideable platform within the housing.

Each of the guide rails 313 extends between a top guide rail end 314 and a bottom guide rail end 315. For example, the bottom guide rail end 315 may be at or near the housing bottom end 330 while the top guide rail end 314 may be relatively closer to the housing top end 320. The top guide rail end 314 may be near or adjacent the housing top end 320 or may be closer to the longitudinal center of the housing. For example, depending on the desired extended use position of the slideable platform, the top guide rail end 314 may not extend to the housing top end 320.

In certain embodiments, the housing is formed of a translucent or transparent material, to provide for observation of the contents of the container assembly in the interior volume, such as for retail packaging purposes and/or for user observation of the contents and operation of the slideable platform through the housing sidewall while the container assembly is in use.

Figure 4:
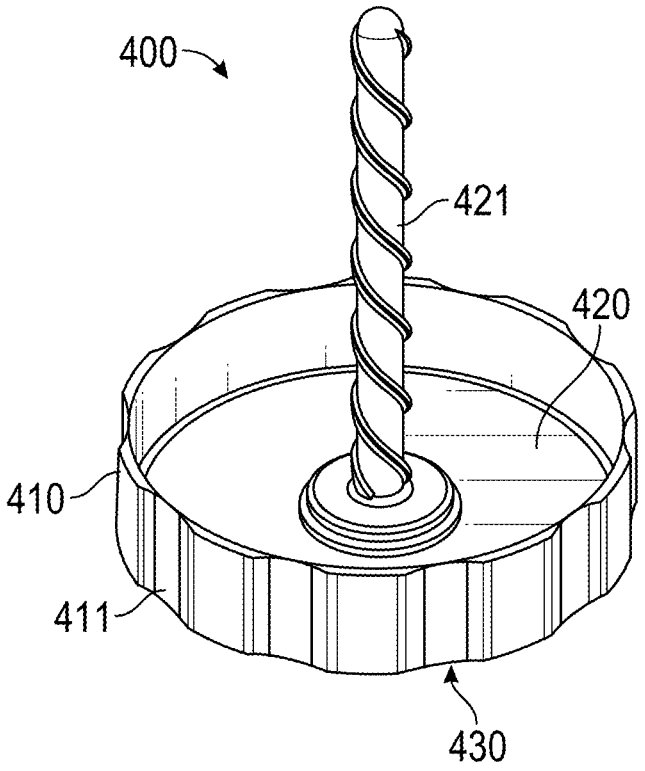
FIG. 4 is perspective view of one embodiment of a manually rotatable base for a writing instrument container assembly, as described herein.
Figure 10:
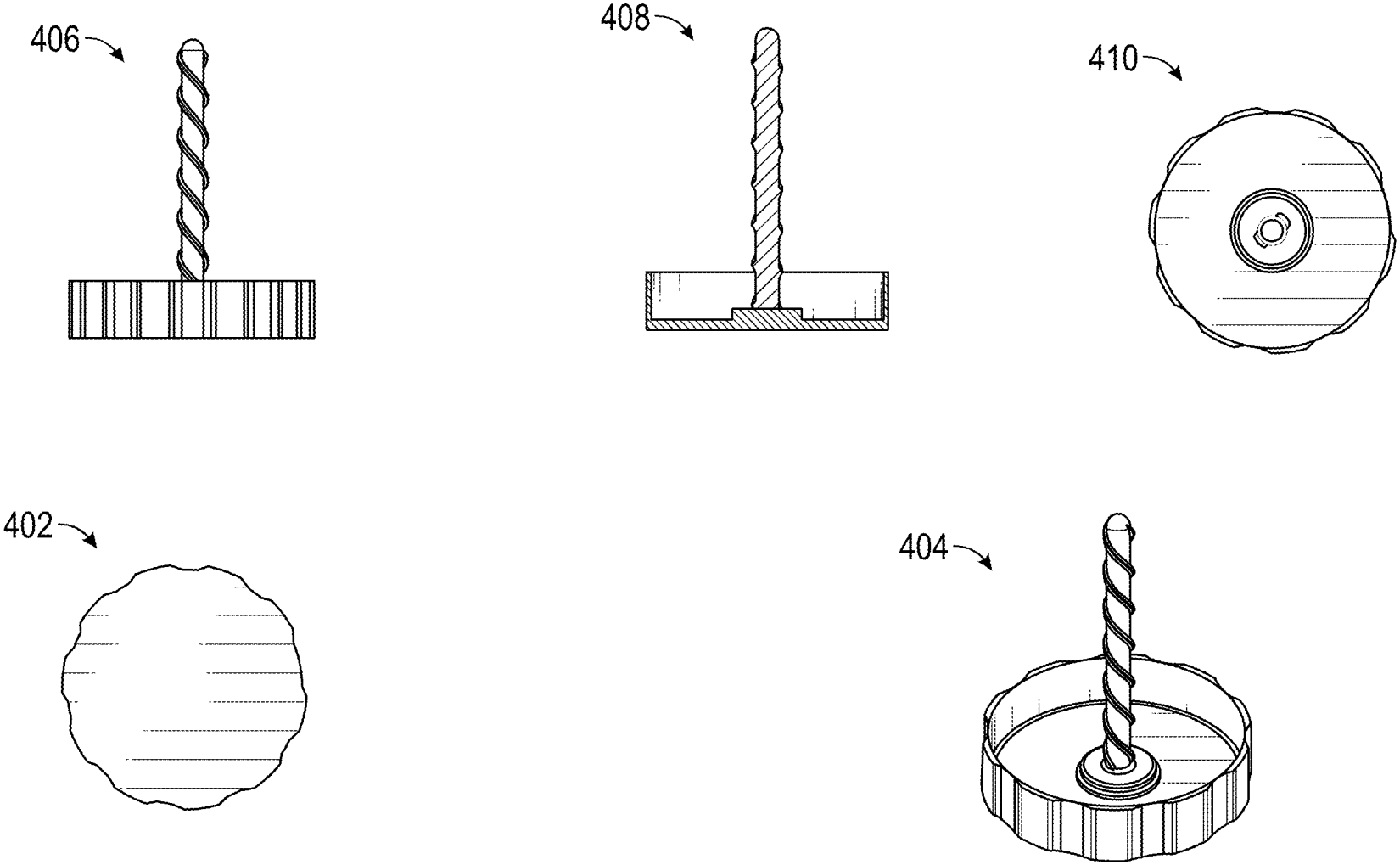
FIG. 10 illustrates various views of one embodiment of a manually rotatable base for a writing instrument container assembly, as described herein.

As shown in detail in FIGS. 4 and 10, the container assembly 10 also includes a manually rotatable base 400. The manually rotatable base 400 is configured to be operably coupled to the housing 300 and rotated by a user to advance or retract the slideable platform 200 via a threaded post 421 in operable communication with the correspondingly threaded hole of the slideable platform 200. For example, the manually rotatable base may be operably coupled to the housing by any suitable means, such as via a snap fit, friction fit, threaded coupling, or other connection means that allows the base to be manually rotated about an axis to rotate the threaded post.

The manually rotatable base 400 has an upper base surface 420 and an opposed lower base surface 430. For example, the upper base surface 420, in combination with the inner housing sidewall surface 311 defines the interior volume of the container assembly.

In certain embodiments, the manually rotatable base 400 further includes a base sidewall 410 defining a grippable outer base sidewall surface 411 for the user to manually grip to rotate the base. For example, the base sidewall may have any suitable shape and dimensions, such as a shape that corresponds to the shape of the housing and/or lid of the container assembly, such as a cylindrical shape. The outer base sidewall surface may optionally have indents for gripping.

The threaded post 421 may extend from the upper base surface 420, such that rotation of the manually rotatable base 400 moves (e.g., advances or retracts) the slideable platform within the housing 300 along the at least one guide rail 313. For example, the threaded post may be a lead screw having a helical thread effective to convert the rotary, turning motion of the base 400 to linear motion of the slideable platform 200.

The threaded post 421 may be integral with or coupled to the upper base surface 420. In certain embodiments, the threaded post is removable coupled to the upper base surface.

The base 400 and housing 300 may be configured so that the base is rotatably, operably coupled to the housing, such as via a snap fit, friction fit, threaded coupling, or other connection means. The base may be removably or irremovably coupled to the housing. In FIG. 10, the base 400 is depicted in bottom view 402, perspective view 404, front view 406, cross-sectional view 408, and top view 410.

In certain embodiments, the container assembly 10 is configured such that the bottom platform surface 230 contacts or nearly contacts the upper base surface 420 when the slideable platform 200 is fully retracted, i.e., in the full storage position. In other embodiments, the assembly may be configured such that the platform does not contact the upper base surface when in the retracted position, e.g., the platform is stopped before reaching the upper base surface by a stopper, by the configuration of the threaded post and base, or other suitable means.

As shown in detail in FIG. 7A, in certain embodiments, the container assembly 10 includes at least one platform stopper 600 that extends from the inner housing sidewall surface 312 or from one or more guide rails 313. The platform stopper may be positioned at a pre-determined height relative to a height of the housing or container assembly and be configured to contact the top platform surface 220 to prevent the slideable platform 200 from advancing past the pre-determined height, i.e., from advancing past the pre-determined height in the direction of the open upper end of the housing or the removable lid. That is, the stopper 600 is a single-direction stopper that beneficially limits the user from advancing the platform 200 out of the housing, off of the threaded post, or past a desired maximum platform height.

The pre-determined height of the platform stopper 600 may be selected based on the particular contents and/or use of the container assembly. In certain embodiments, the pre-determined height is from 25 percent to 75 percent of a housing height measured from the housing top end to the housing bottom end, such as from 40 percent to 60 percent of a housing height measured from the housing top end to the housing bottom end. In some embodiments, the pre-determined height is at least one inch from the housing top end, such as from one inch to 4 inches from the housing top end. In certain embodiments, the pre-determined height is approximately halfway between a top guide rail end and a bottom guide rail end of each of the at least one guide rails.

The platform stopper may have any suitable dimensions, geometry and position to effectively prevent a user from advancing the slideable platform past the pre-determined height. In certain embodiments, as shown in FIG. 7A, the platform stopper is in the form of a projecting ledge that extends from one of the guide rails. In certain embodiments, the platform stopper is integrally formed with the guide rail(s) and/or the housing.

The container assembly may be sized and shaped to effectively store any number, size, and shape of goods. For example, the container assembly may be designed to store writing instruments, such as pens or markers, which may have a length of from about 5 inches to about 6 inches. In such embodiments, the stopper may be positioned to prevent advancement of the platform past a height at which the pens or markers may tip over the rim of the housing. In certain embodiments, the container assembly may be designed to store about 20 pens or markers.

Figure 5:
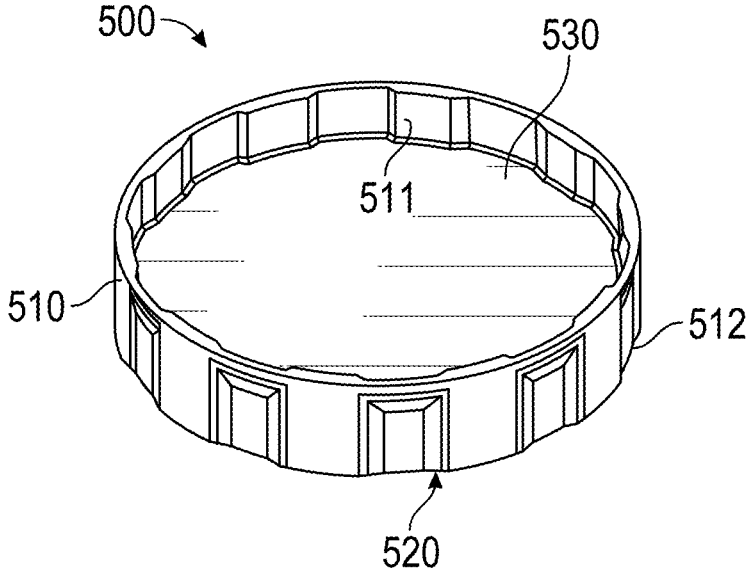
FIG. 5 is a perspective view of one embodiment of a lid for a writing instrument container assembly, as described herein.
Figure 12:
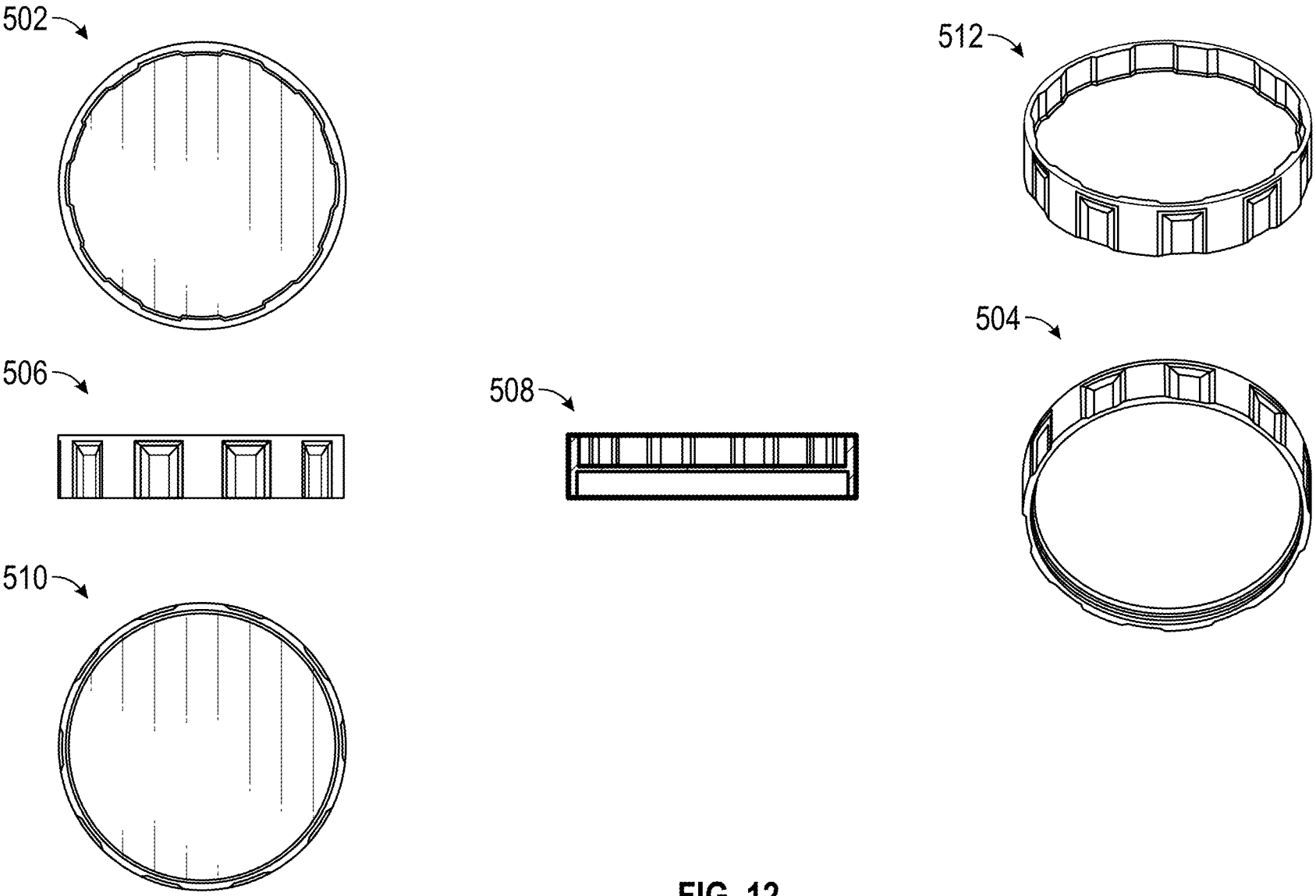
FIG. 12 illustrates various views of one embodiment of a lid for a writing instrument container assembly, as described herein.

As shown in detail in FIGS. 5 and 12, in certain embodiments, the container assembly 10 further includes a removable lid 500. For example, the lid 500 may be selectively removable by a user to transition the container assembly 10 between a closed, storage position, in which the interior volume of the container assembly or housing is securely contained (see FIG. 1), and a use position, in which the contents are accessible to a user via the open end 502 of the housing (see FIG. 6). In FIG. 12, the removable lid 500 is depicted in bottom view 502, bottom perspective view 504, front view 506, cross-sectional view 508, top view 510, and top perspective view 512.

The lid may have any suitable geometry and size to effectively close the interior volume of the container. For example, the lid may have an overall shape similar to that of the cross-sectional shape of the housing, such as a circular, elliptical, oval, triangular, rectangular/square, hexagonal, or octagonal shape. For example, a sidewall of the lid may be substantially cylindrical in shape.

In certain embodiments, as shown in FIG. 5, the lid includes a lid sidewall 510 extending between a lid top end 530 and an opposed lid bottom end 520. In some embodiments, the lid sidewall 510 has an inner lid sidewall surface 511 and an outer lid sidewall surface 512.

The removable lid 500 may be configured to be secured to the housing at the housing opening formed at the housing top end, effectively closing the interior volume of the container, by any suitable means, such as via a snap fit, friction fit, threaded coupling, or other connection means. In one embodiment, as shown in FIG. 6, the inner lid sidewall surface comprises lid threads and the outer housing sidewall surface comprises corresponding housing threads, such that the lid is removably securable on the housing top end.

Figure 6:
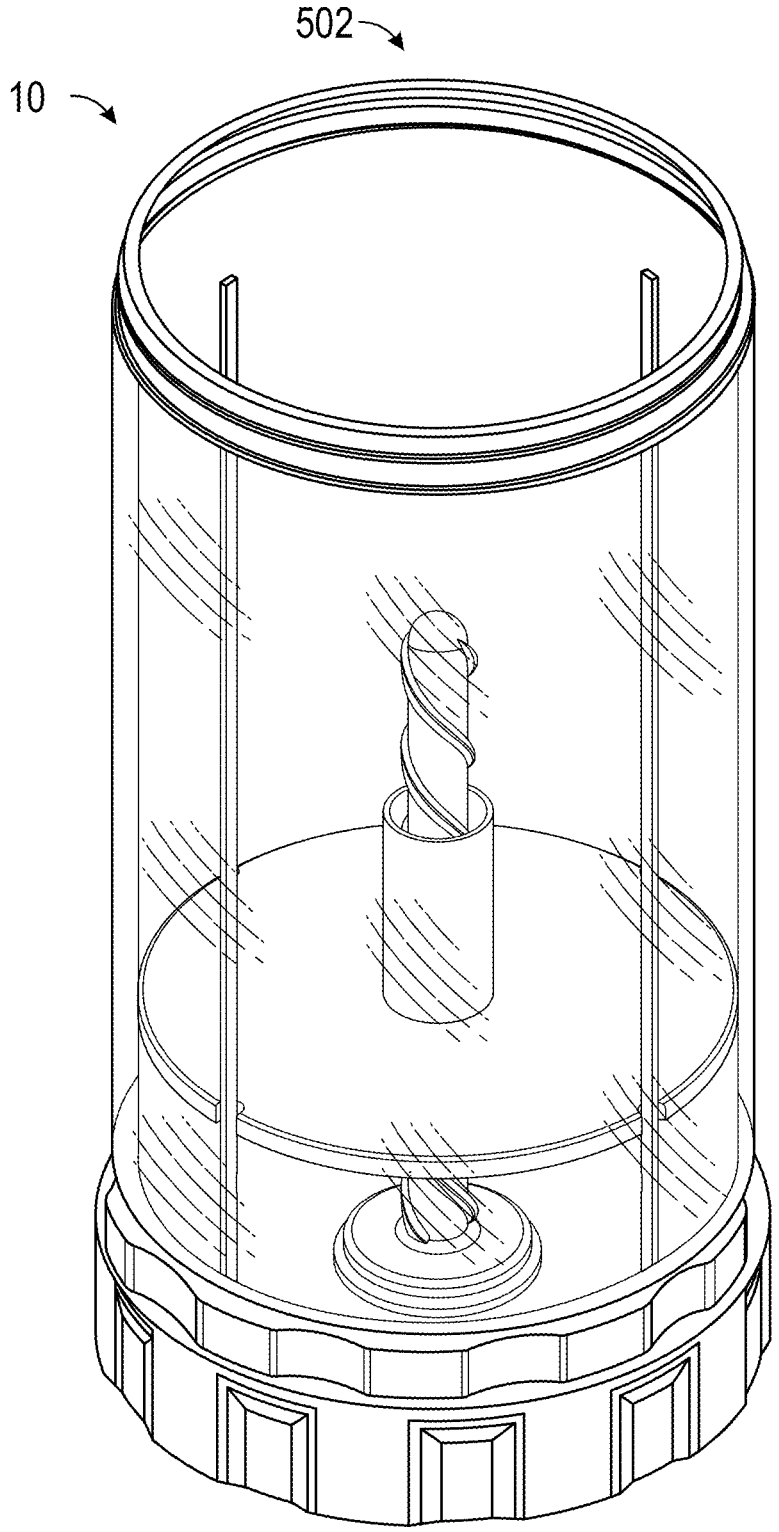
FIG. 6 is a perspective view of one embodiment of a writing instrument container assembly having the lid secured on the manually rotatable base, as described herein.

The removable lid 500 also may be configured to be selectively secured to the manually rotatable base, as shown in FIG. 6, at the housing bottom end, to allow for securing the lid to the container assembly even when the container assembly is in a use position. The removable lid 500 may be configured to be secured to the manually rotatable base by any suitable means, such as via a snap fit, friction fit, threaded coupling, or other connection means. In certain embodiments, the manually rotatable base remains manually rotatable when the removable lid is attached thereto, such that a user can advance the platform by rotating the base and attached lid.

In one embodiment, as shown in FIG. 6, the manually rotatable base has an outer base sidewall surface with a smaller diameter than the inner lid sidewall surface, and the lid is configured to removably secure the manually rotatable base therein. Other attachment configurations between the lid and base are also envisioned.

In certain embodiments, in use, the lid is removed by hand twisting to the right, to decouple the threaded lid from the threaded housing. Once the lid is removed, the lid can be secured under the base. As discussed, the inner diameter of the top of the lid may be larger than the outer diameter of the base. This allows the parts to be coupled for easy storage of the lid. In order to raise the platform within the housing, the manually rotatable base is twisted to the right. This allows for the product inside the housing to move upward, and optionally past the top of the rim of the housing opening, thus acting like a typical desk storage cup. The platform may be retracted by twisting the base to the left.

Thus, this disclosure solves the need for a reusable package for retail display that is also functional. Beneficially, this packaging design will reduce waste by allowing the consumer to use the contain assembly in a variety of different ways. For example, the user can carry the cup around like any bottle. In transport, this design can be stored in automobile cup holders, backpack cup sleeves, or in a human hand. When the cup is going to be stationary for an extended period of time, the added benefit of activating the platform can be applied.

In certain embodiments, the container assembly is manufactured by coupling the base to the bottom of the housing, inserting the platform through the top of the cup, such that the threads are aligned in order to allow for the platform to run up and down by twisting the base, loading the contents, such as writing products, into the housing to be supported by the platform, and coupling the lid on the top to close the container. As discussed above, once removed, the lid can be attached under the base for easy storage while the container is in use. The lid can be reused so the user can easily carry the product around with them.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific mechanisms and configurations, it will be appreciated that numerous other mechanisms and configurations are within the scope of the disclosure.

Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments. Directional terminology, such as "top," "bottom," "upper," "lower," and the like, refer to the container assembly in typical use, with the base relatively closer to the ground and the open end of the housing that selectively receives the lid relatively farther from the ground.

The meanings of the terms used herein will be apparent to one of ordinary skill in the art or will become apparent to one of ordinary skill in the art upon review of the detailed description when taken in conjunction with the several drawings and the appended claims.

What is claimed is:

1. A container assembly for writing instruments, comprising:

a slideable platform comprising at least one platform sidewall extending between a top platform surface and a bottom platform surface and comprising at least one groove, and a threaded hole extending between the top platform surface and the bottom platform surface, the threaded hole being configured to operably receive a threaded post therethrough;

a housing comprising at least one housing sidewall extending between a housing top end and a housing bottom end and surrounding the slideable platform, the at least one housing sidewall comprising an outer housing sidewall surface and an inner housing sidewall surface, the inner housing sidewall surface having at least one guide rail disposed thereon, wherein each of the at least one guide rails is positioned within one of the at least one grooves such that the slideable platform is slideable along each of the at least one guide rails;

a manually rotatable base comprising an upper base surface and a lower base surface, the upper base surface having the threaded post extending therefrom, such that rotation of the manually rotatable base moves the slideable platform within the housing along the at least one guide rail; and at least one platform stopper extending from the inner housing sidewall surface or from at least one of the at least one guide rails at a pre-determined height, the at least one platform stopper being configured to contact the top platform surface to prevent the slideable platform from advancing past the pre-determined height, wherein the pre-determined height is selected such that the writing instruments are retained by the housing in the container assembly when the slideable platform is in contact with the at least one platform stopper.

2. The container assembly of claim 1, wherein the pre-determined height is from 25 percent to 75 percent of a housing height measured from the housing top end to the housing bottom end.

3. The container assembly of claim 1, wherein the pre-determined height is from 40 percent to 60 percent of a housing height measured from the housing top end to the housing bottom end.

4. The container assembly of claim 1, wherein the pre-determined height is at least one inch from the housing top end.

5. The container assembly of claim 1, wherein the pre-determined height is from one inch to 4 inches from the housing top end.

6. The container assembly of claim 1, wherein the pre-determined height is halfway between a top guide rail end and a bottom guide rail end of each of the at least one guide rails.

7. The container assembly of claim 1, wherein the at least one guide rail consists of from three to five guide rails.

8. The container assembly of claim 1, wherein the at least one guide rail consists of four guide rails.

9. The container assembly of claim 7, wherein the at least one groove consists of from three to five grooves.

10. The container assembly of claim 8, wherein the at least one groove consists of four grooves.

11. The container assembly of claim 1, wherein each of the at least one platform stoppers is integral with one of the at least one guide rails.

12. The container assembly of claim 1, wherein the housing comprises one housing sidewall that is cylindrical.

13. The container assembly of claim 12, wherein the slideable platform comprises one platform sidewall that is cylindrical, and wherein the manually rotatable base comprises a cylindrical base sidewall.

14. The container assembly of claim 1, further comprising a removable lid, wherein the lid comprises a lid sidewall extending between a lid top end and a lid bottom end, the lid sidewall comprising an inner lid sidewall surface and an outer lid sidewall surface.

15. The container assembly of claim 14, wherein the inner lid sidewall surface comprises lid threads and the outer housing sidewall surface comprises corresponding housing threads, such that the lid is removably securable on the housing top end.

16. The container assembly of claim 14, wherein the manually rotatable base comprises an outer base sidewall surface having a smaller diameter than the inner lid sidewall surface, and the lid is configured to removably secure the manually rotatable base therein.

17. The container assembly of claim 1, wherein the threaded post is removably coupled to the upper base surface.

18. The container assembly of claim 1, wherein a protective sleeve extends from the top platform surface and is configured to receive the threaded post therethrough.

19. The container assembly of claim 1, wherein the housing is formed of a translucent or transparent material.

20. A container assembly for non-flowable contents, comprising:

a slideable platform comprising at least one platform sidewall extending between a top platform surface and a bottom platform surface and comprising at least one groove, and a threaded hole extending between the top platform surface and the bottom platform surface, the threaded hole being configured to operably receive a threaded post therethrough;

a housing comprising at least one housing sidewall extending between a housing top end and a housing bottom end and surrounding the slideable platform, the at least one housing sidewall comprising an outer housing sidewall surface and an inner housing sidewall surface, the inner housing sidewall surface having at least one guide rail disposed thereon, wherein each of the at least one guide rails is positioned within one of the at least one grooves such that the slideable platform is slideable along each of the at least one guide rails;

a manually rotatable base comprising an upper base surface and a lower base surface, the upper base surface having the threaded post extending therefrom, such that rotation of the manually rotatable base moves the slideable platform within the housing along the at least one guide rail; and at least one platform stopper extending from the inner housing sidewall surface or from at least one of the at least one guide rails at a pre-determined height, the at least one platform stopper being configured to contact the top platform surface to prevent the slideable platform from advancing past the pre-determined height.

* * * * *